367-93 $$$ SR
E245K XR 4,103,293

United States Patent [19] [11] 4,103,293
La Forge, Jr. [45] Jul. 25, 1978

[54] INTRUSION ALARM APPARATUS

[75] Inventor: Louis H. La Forge, Jr., San Mateo, Calif.

[73] Assignee: Tri-Century Industries, Inc., San Mateo, Calif.

[21] Appl. No.: 634,062

[22] Filed: Nov. 21, 1975

[51] Int. Cl.[2] ..... G08B 13/14
[52] U.S. Cl. ..... 340/514; 340/522; 340/552; 340/558
[58] Field of Search ..... 340/258 B, 258 C, 411

[56] References Cited

U.S. PATENT DOCUMENTS

| | | | |
|---|---|---|---|
| 3,697,972 | 10/1972 | Brown | 340/258 C |
| 3,733,602 | 5/1973 | Cuckler | 340/258 B |
| 3,778,807 | 12/1973 | Ralston | 340/258 C |
| 3,873,981 | 3/1975 | Bloice | 340/258 B |
| 3,886,413 | 5/1975 | Dow | 340/411 |
| 3,932,870 | 1/1976 | Shapiro | 340/411 |
| 3,940,733 | 2/1976 | Johnson | 340/258 B |
| 3,967,161 | 6/1976 | Lichtbau | 340/258 C |

*Primary Examiner*—Harold I. Pitts
*Attorney, Agent, or Firm*—Flehr, Hohbach, Test, Albritton & Herbert

[57] ABSTRACT

An intrusion detection apparatus employing two or more diverse types of sensors for sensing entries into a room, building or other enclosure. The sensors are connected to a signal processor which processes sensor output signals to indicate when an intrusion has occured. One type of sensor is a local sensor which includes a sensor conductor in combination with a phase locked loop. Whenever an intruding object is within close proximity to the sensor conductor and disturbs the conductor field, the equilibrium condition of the phase locked loop is disturbed to provide a sensor output signal. A second type of sensor includes in one embodiment an omni-directional antenna having a field which is located in close proximity to or which is overlapping the field of the sensor conductor. Whenever the omni-directional antenna and the sensor conductor are disturbed, the two disturbances are detected by the signal processor to signal an intrusion if the proper time relationship exists between them.

27 Claims, 5 Drawing Figures

INTRUSION ALARM APPARATUS

CROSS REFERENCE TO RELATED APPLICATION

INTRUSION ALARM SYSTEM, invented by Louis H. La Forge Jr., Ser. No. 518,602 filed Oct. 29, 1975, now U.S. Pat. No. 3,947,838.

BACKGROUND OF THE INVENTION

The present invention relates to the field of alarm systems and particularly to an intrusion detection apparatus for use in detecting intrusions into homes, stores, factories or other enclosures.

Prior devices for detecting intrusions have relied upon many different principles. For example, contact switches have been mounted on each door and window of an enclosure. Upon opening a door or window, the switch is actuated to set off an alarm. Similarly, radiation devices have been employed wherein an entry into an enclosure causes the radiation field to be disturbed thereby setting off an alarm.

Other devices have relied upon the differential air pressure between an enclosure and the external environment. Such an apparatus is described in U.S. Pat. No. 3,829,851. An improved differential pressure device is described in the above cross-referenced patent application.

While some of the above instrusion detecton devices have a high level of sensitivity, they still exhibit problems in reliability. The reliability problem generally results in too many false alarms. In general, all of the intrusion alarm systems which have been on the market suffer from a level of false alarms which is too high.

In view of the above background of the invention, there is a need and it is an object of the present invention to provide an improved intrusion alarm system which is highly sensitive to intrusions while having an improved ability to distinguish between intrusions and false alarm conditions.

SUMMARY OF THE INVENTION

The present invention is an intrusion detection apparatus for detecting intrusions into an enclosure. A first sensor of one type is located in or in close proximity to an enclosure. A second sensor of a different type is also located in or in close proximity to the enclosure. Each sensor provides an output signal when an intrusion is detected. The first and second sensors are of diverse types so that each has different false alarm characteristics. A signal process is connected to receive an output signal from each of the sensors. The signal processor operates to signal the occurrence of an intrusion only when both the first and second sensors provide output signals in the proper time relationship.

In accordance with one aspect of the present invention, a first sensor, a local sensor, includes a sensor conductor which is conditioned to establish a local field of detection. The local sensor is connected to transmit and receive signals from and to central control. The transmission typically is over the normal power wiring in the building or other enclosures. A disturbance in the local field of the sensor conductor causes a change in the local sensor which is in turn transmitted to the central control.

In accordance with one aspect of the present invention, the local sensor includes a local frequency generator which is connected to transmit sensor signals to the central control.

In accordance with one embodiment of the present invention, the local sensor includes a frequency-sensitive phase locked loop. The phase locked loop is connected to the sensor conductor which provides one control input. A second input to the local sensor is a control signal which is received from the central control. The phase locked loop locks upon the frequency provided by the central control. Whenever an intrusion or other disturbance interferes with the field of the local sensor conductor, the local sensor phase locked loop responsively changes equilibrium conditions to provide a loop output signal. The local sensor also includes a local oscillator which provides the local sensor output signal in response to the loop output signal. The local sensor output signal is transmitted to the central control. The central control senses the presence of the local sensor output signal.

In accordance with another aspect of the present invention, one central control is connected to a plurality of local sensors. The connection of each of the local sensors typically is over the normal power wiring in a building.

In accordance with another aspect of the present invention, a second type of sensor, an interior sensor, is provided. The interior sensor is typically an omni-directional radiation device. The interior sensor in one embodiment has a radiation field which encompasses substantially the entire volume of the building or other enclosure to be protected. The interior sensor, therefore, provides an interior sensor output signal to signal intrusions throughout substantially the entire enclosure. By way of contrast, the local sensors operate to detect disturbances within a comparatively small local portion of the overall enclosure. In a typical building, the local sensor conductors are designed to be placed around individual doors, windows and other potential entry spots into the enclosure.

In accordance with one aspect of the invention, the central control includes apparatus for transmitting the control signals to each of the local sensors and for receiving local sensor output signals from each of the local sensors. In one embodiment, the control signal is either at an operating frequency or a test frequency. Whenever the test frequency control signal is transmitted, the local sensors react to provide a sensor output signal as if a disturbance to the local sensor field had occurred. In this manner, each of the local sensors is tested to assure that each is operational. The central control, in one embodiment, includes a central store for storing the active or inactive state of each of the local sensors.

In accordance with one aspect of the invention, the central control includes apparatus for time processing the local sensor and the interior sensor output signals whereby a predetermined time relationship between signals exists before an intrusion is indicated.

In accordance with the above summry, the present invention achieves the objective of providing improved detection apparatus which includes two or more diverse type sensors and which provides intrusion indications with greater reliability.

DETAILED DESCRIPTION

Figure 1:
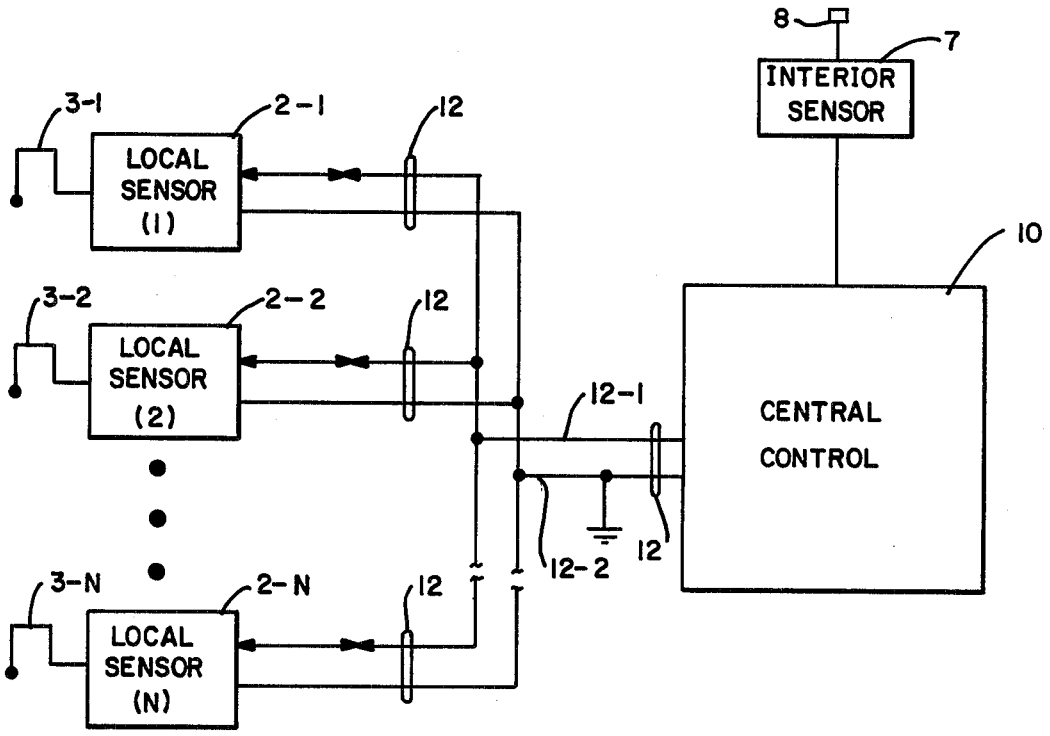
FIG. 1 depicts an overall electrical block diagram of an intrusion alarm apparatus in accordance with the present invention.
Figure 2:
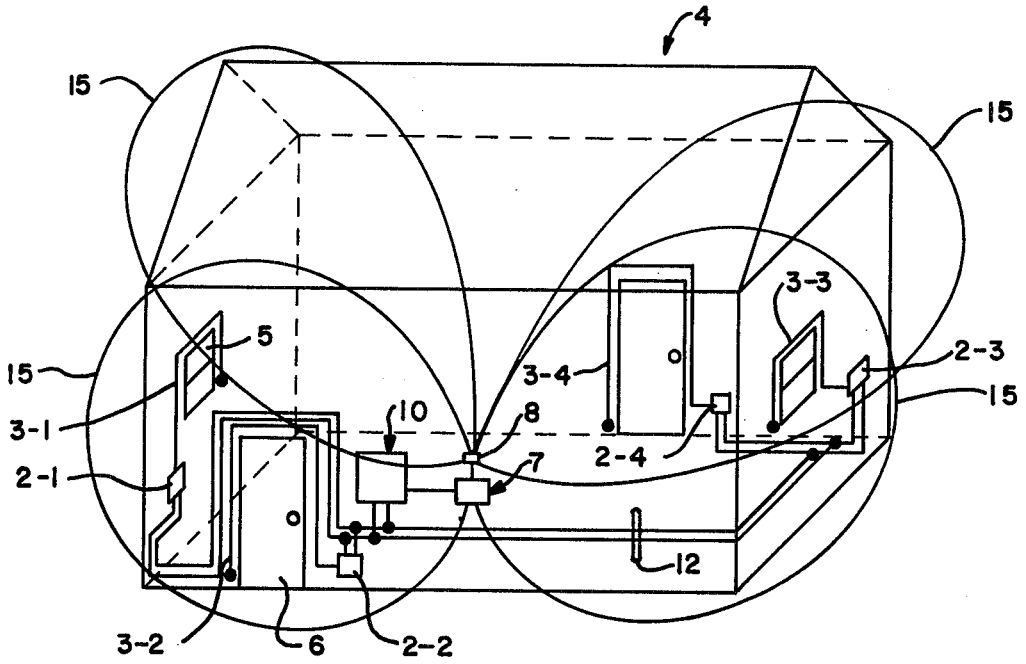
FIG. 2 depicts a schematic representation of the apparatus of FIG. 1 located within a typical enclosure.

In FIG. 1, the intrusion alarm system includes a plurality of local sensors 2-1, 2-2, . . . , 2-N. Each of the local sensors 2 is typically of a first type and each has a local sensor conductor 3. Each of the sensor conductors 3 is connected at a location within an enclosure 4 as shown in FIG. 2. For example, the sensor conductor 3-1 of the local sensor 2-1 connects around a window frame 5. Similarly, the sensor conductor 3-2 of the local sensor 2-2 connects around a door frame 6. Passage of a body, such as a person, through or near the area of the sensor conductor 3-1 causes the field of conductor 3-1 to be disturbed. When thus disturbed, a signal is generated bu the local sensor 2-1. Similarly, passage of a body through or near the door frame 6 causes the field of the sensor conductor 3-2 to be disturbed and a responsive signal to be generated in local sensor 2-2. Any number of local sensors 3 in FIG. 1 and FIG. 2 are provided to be placed at locations throughout the enclosure 4 of FIG. 2.

In a similar manner, a second type of sensor, an interior sensor 7, is provided for detecting disturbances within or in the vicinity of the enclosure 4. In one particular embodiment, the interior sensor 7 includes an omni-directional antenna 8, which has a field pattern 15 which substantially encompasses the entire enclosure 4. Both the local sensors 2 and the interior sensor 7 are connected to the central control 10. The central control 10, in response to information from the local sensors 2 and the sensor 7, provides alarm signals to signify intrusions.

In FIG. 2, the field pattern 15 from the interior sensor 7 encompasses essentially all of the volume of the enclosure 4. In a preferred embodiment, interior sensor 7 is a device which functions as a motion detector and detects movement of a body within enclosure 4. One device of this type is marketed by Casady Engineering Associates and is a continuous wave doppler radar, Model 170. When enclosures 4 are typical houses, a radar operating at UHF or VHF frequencies is desirable in order to have penetration of the signal through internal walls.

Where the particular characteristics of the enclosure prevent a single interior sensor from establishing the desired field pattern, two or more of the interior sensors may be employed. Other types of interior sensors also may be employed. For example, ultrasonic sensors are suitable. One ultrasonic sensor suitable for use is marketed by Delta Products, Inc., Model 10412.

In FIG. 1 and FIG. 2, the local sensors 2 connect to the central control 10 over the normal power wiring 12 of the enclosure 4. The power wiring is usually 110 volts appearing between a ground line 12-2 and a single phase line 12-1. The local sensors 2 of FIG. 1 and FIG. 2 typically are plug connected into normal convenience outlets (not shown) without need of any special connections. When an enclosure includes 220 volt sevice or other service having additional single phase or multiple phase lines (not shown) the signals between phase lines normally will couple due to the proximity of wires. Alternatively, capacitive interconnects between the various phase lines may be employed to insure that signals couple between the local sensors and the central control.

Figure 3:
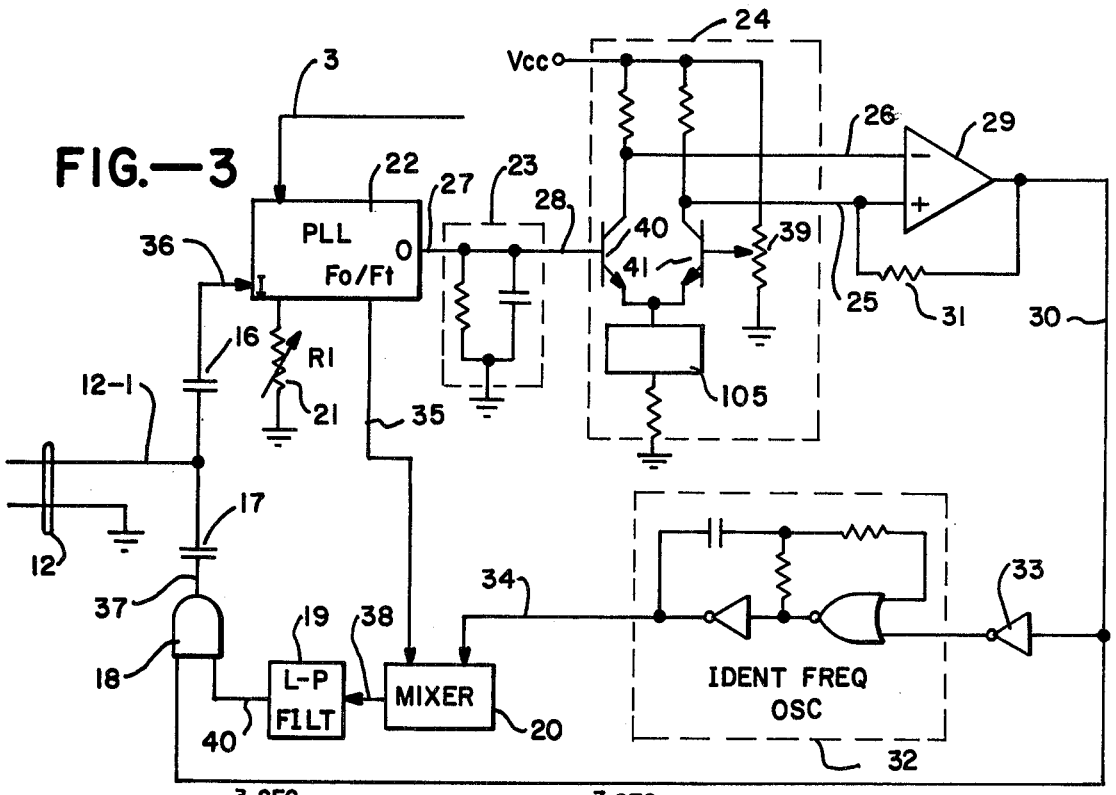
FIG. 3 depicts the details of one local sensor suitable for use within the FIG. 1 apparatus.

Referring to FIG. 3, a typical one of the local sensors 2 of FIG. 1 is shown. The signal line input and output, appears on the power line 12. The power line 12-1 connects through the isolating capacitors 16 and 17. Each of the capacitors 16 and 17 is typically $10^{-10}$ farads. Capacitor 16 connects input signals to the phase locked loop (PLL) 22 and capacitor 17 connects signals from line 37 out to power line 12-1.

Phase locked loop 22 is a conventional device. In one example, the loop 22 is an RCA COS/MOS Phase-Locked Loop, Model CD4046A. That circuit is described in the RCA publication "SOLID STATE '74 DATA BOOK SERIES SSD-203B" in application note ICAN-6101. The phase locked loop 22 locks upon the frequency of the input signal which appears on input line 36. Loop 22, in an embodiment of the present invention, locks on to either an operating frequency, Fo, which is typically 475 KHz or on to a test frequency, Ft, which is typically 478.7 KHz.

The phase locked loop 22 is connected to the local sensor conductor 3. The conductor 3 has a reactance value (e.g., capacitance) which serves as an additional input to loop 22 and which effects the equiibrium condition of the phase locked loop. The output on line 27 from the phase locked loop has a voltage level which is a function of the frequency of the input signal on line 36 and of the reactance value of the input on line 3. The voltage level of the output on line 27 is adjustable over a small range by adjusting the resistance value of the variable resistor R1. The phase locked loop 22 also provides an output frequency on line 35 which corresponds to the frequency at which the loop 22 is locked.

In FIG. 3, a low pass filter 23 receives the output on line 27 from the loop 22 and provides a filterted signal on line 28. Filter 23 is of conventional design and, in one embodiment, has a cut off frequency of 0.1 Hz. The filtered signal on line 28 is input to an impedance transfer circuit 24. The impedance transfer circuit 24, typically of RCA type CA3045, has outputs on lines 25 and 26. The output on line 25 is a reference established by the balancing variable resistor 39 connected between ground and source, Vcc. The signal on line 28 controls the conduction state of transistor 40. Whenever the operating frequency, Fo, is present on the input line 36, and the field of the sensor conductor 3 has not been disturbed, the voltage levels on the outputs 25 and 26 are approximately equal with output 26 slightly more positive than output 25. Whenever the phase locked loop senses a disturbance in the field of sensor conductor 3 or alternatively receives a test frequency, Ft, input on line 36, the signal on line 26 becomes more negative than the signal on line 25.

The lines 25 and 26 connect to the operational transconductance amplifier 29. Amplifier 29, including the feedback resistor 31, is a bi-stable comparator of the signals on the lines 25 and 26 and is typically an RCA CA3060 micropower amplifier. Whenever the signal on line 26 is more positive than the signal on line 25, the output on line 30 from amplifier 29 is a logical 0. Whenever the signal on line 25 is more positive than the signal on line 26, the output on line 30 is a logical 1. Accordingly, for an Fo input on line 36 to loop 22, under the condition that the sensor conductor 3 has not been disturbed, the signal on line 30 is a logical 0.

Under the condition that the operating frequency is input on line 36 when the sensor conductor 3 is disturbed, or alternatively that the test frequency is input on line 36, the output on line 30 is a logical 1.

The 1 or 0 on line 30 is input to the inverter 33 and to the AND gate 18. A logical 1 on line 30 enables gate 18 and a logical 0 inhibits gate 18.

A logical 0, signifying the Fo frequency, is inverted in inverter 33 to inhibit the identity frequency oscillator 32. When thus inhibited, oscillator 32 provides no output signal on line 34. A logical 1 on line 30 is inverted in inverter 33 to enable the oscillator 32. When thus enabled, oscillator 32 provides an identity frequency, Fi, on line 34. The identity frequency Fi is a different value for each of the sensors 2-1, 2-2, . . . , 2-N of FIG. 1. In this manner, each of the local sensors 2 of FIG. 1 can be distinguished by the central control 10 of FIG. 1.

In FIG. 3, the frequency of an oscillator 32-1 a first for one of the local sensors is typically 25.00 KHz. Each of the other frequencies starting with a second one of the oscillators 32-2 (not shown) differs from the previous one by a fixed amount which difference is, for example, 928 Hz. Accordingly, each of the oscillators 32 is operative to produce a local oscillator identification frequency, Fi, whenever the Ft signal appears on line 36 or whenever the Fo signal appears on line 36 and the sensor conductor 3 has been disturbed.

The output Fi from the local frequency oscillator 32 is connected via line 34 to a conventional mixer 20. Mixer 20 forms the sum and difference frequencies of the signals on lines 34 and 35. The signal on line 35 will be equal to either Ft or Fo. Accordingly, whenever Ft is present on line 35 the output on line 38 will equal to Ft ± Fi. Whenever Fo appears on line 35, the output on line 38 will be Fo ± Fi. If no signal appears on line 34, then the signal on line 38 is either Ft or Fo depending upon the input on line 35.

The output line 38 from mixer 20 connects as an input to a conventional low-pass filter 19. Filter 19 has a cut off frequency of approximately 460 KHz so that only the difference frequencies appear on line 40 output from filter 19. Therefore, the signal on line 40 will be Ft-Fi provided that Ft appears on line 35 and provided that Fi appears on line 34. Alternatively, the signal on line 40 will equal Fo - Fi provided that Fo appears on line 35 and provided that Fi appears on line 34.

In FIG. 3, the AND gate 18 is turned on and off at the difference frequency whenever it appears on line 40 provided that the input on line 30 is an enabling one. When enabled, the AND gate 18 provides the signal on output line 37 which connects through the coupling capacitor 17 to the power line 12-1 for transmission to the central control 10 of FIG. 1.

Figure 4:
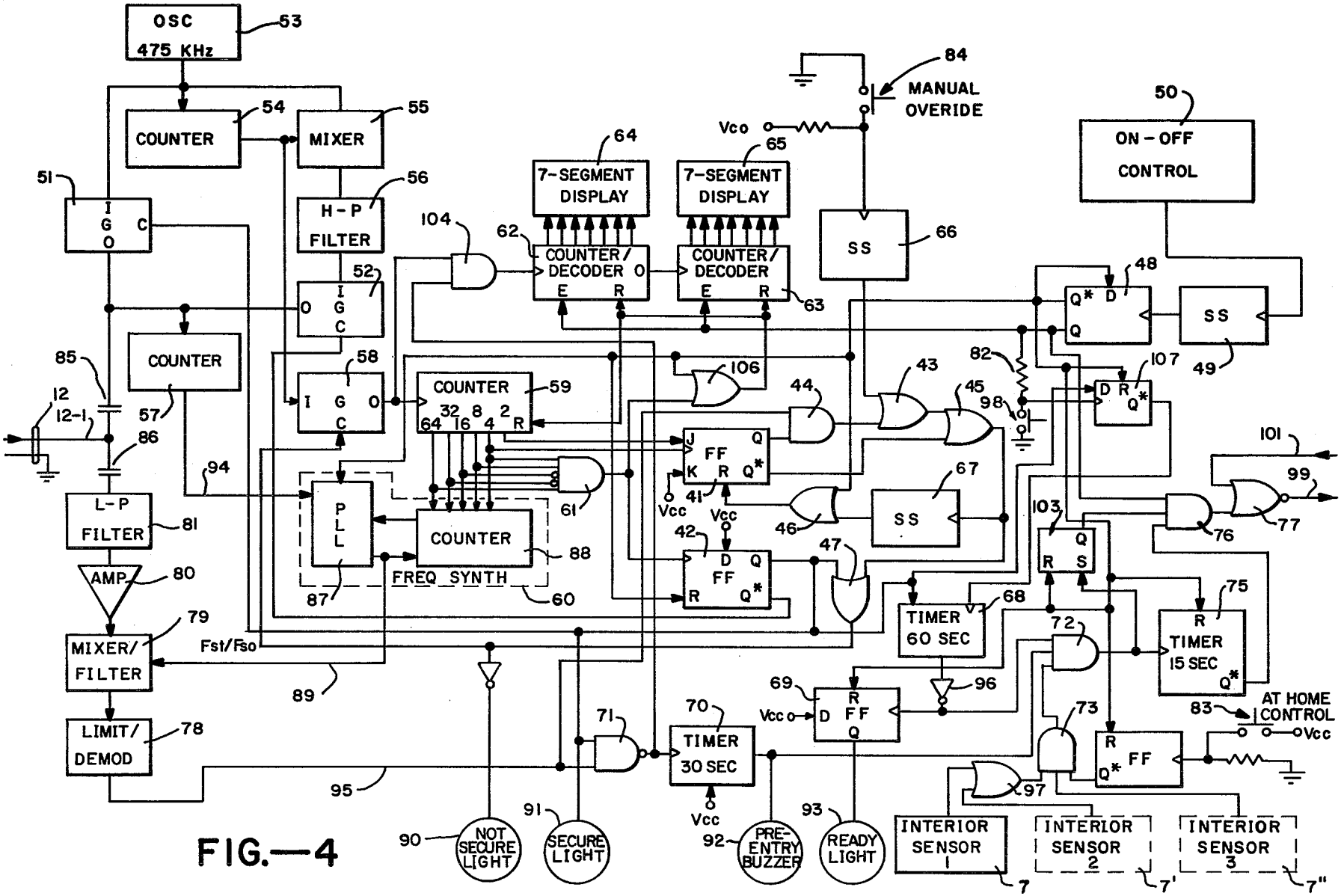
FIG. 4 depicts a schematic representation of the central control of the FIG. 1 apparatus.

In FIG. 4, one detailed embodiment of the central control 10 of FIG. 1 is shown together with one or more interior sensors 7. The central control 10 includes the power line 12 for receiving the input signals and for transmitting the output signals. The power line 12-1 connects to capacitors 85 and 86 for coupling out from and into the control unit, respectively. The capacitors 85 and 86 are typically $10^{-10}$ farads.

Output signals are conducted through capacitor 85 from the output of either conventional analog gate 51 or conventional analog gate 52. Only one of the gates 51 or 52 is open and the other is closed. Gates 51 and 52 are controlled via their respective control inputs (C). Gate 51 is connected at its input (I) to a conventional crystal controlled oscillator 53. Oscillator 53, in one preferred embodiment, has a frequency of 475 KHz. Whenever gate 51 is selected with a 1 on its C input the 475 KHz signal on its I input appears on its O output.

In a similar manner, gate 52 receives a 478.7 KHz signal on its I input and provides that signal on its 0 output whenever its C input is a 1. The 478.7 KHz signal is provided on the I input of gate 52 from the crystal controlled oscillator 53 through mixer 55 and high-pass filter 56.

Oscillator 53 connects as an input to the 7 stage binary counter 54. Counter 54 provides a 3.7 KHz output as a count down of the oscillator 53 input. The 3.7 KHz output from counter 54 is mixed with the 475 KHz signal in conventional mixer 55. Mixer 55 provides the sum and difference outputs as an input to the high-pass filter 56. High-pass filter 56 is selected to have a cut-off so that only the sum signal from the mixer 55 appears on the output from filter 56. That sum signal from filter 56 is 478.7 KHz in the embodiment described.

The 3.7 KHz signal from counter 54 is also provided at the I input of the conventional analog gate 58. Gate 58 provides the 3.7 KHz signal on its 0 output whenever its C input is a 1. The control inputs to the gates 51, 52 and 58 are derived either directly or indirectly from the flip-flops 41 and 42 to be hereinafter described.

Whenever the gate 58 is controlled to pass the 3.7 KHz signal, that signal steps the counters 59, 62 and 63. Counter 59 is a conventional 7 stage binary counter. Counter 59 has the binary outputs 1, 2, 4, 8, 16, 32 and 64. The low order count of 1 is not used. The 2 output is connected to the clock input of a conventional JK flip-flop 41. The 4 output of counter 59 is connected to the J input of flip-flop 41. The 4, 8, 16, 32 and 64 outputs of counter 59 are connected as a count input to the frequency synthesizer 60. Frequency synthesizer 60 is comprised of a phase locked loop 87 and a counter 88 connected in the manner described in the RCA SOLID STATE '74 DATA BOOK SERIES SSD-203B application note ICAN 6101. For each number representing one count of counter 59, a different synthesizer output frequency, Fs, appears on the output line 89.

The Fs frequency is different for each count in the counter 59. In one embodiment of the present invention, counter 59 counts through 19 counts so that 18 different frequencies Fs are produced. In addition, the frequency Fs differs depending upon the frequency which appears on line 94 as an input to the synthesizer 60. The frequency on line 94 in one preferred embodiment is approximately either 928 Hz or 935 Hz. Frequencies on line 94 are derived as a count down of the output from either gate 51 or gate 52 depending upon which gate is conducting. In the particular embodiment described, 36 different frequencies appear for the Fs frequency. There are 18 frequencies associated with the operation frequency Fo and there are 18 frequencies associated with the test frequency Ft. The different frequencies for Fs are identified hereinafter in CHART I as Fst and Fso.

The frequency Fs on line 89 is input to a conventional mixer 79. Mixer 79 receives another input from the local sensors via the power line 12-1, isolation capacitor 86, low pass filter 81 and an amplifier 80. Low pass filter 81 is set with a cut-off frequency of approximately 460 KHz. Mixer 79 mixes the frequency Fs with the frequencies received on line 12-1 to form sum and difference signals. Mixer 79 includes a conventional band-pass filter for passing only the difference signals. Accordingly an output from mixer 79 is a signal Fs -(Fo-Fi) or -(Ft-Fi). A conventional limiter and demodulator 78 demodulates the output signal to produce a control signal on line 95. A control signal will appear as a logical 1 on line 95 only when the count in counter 59, and hence the corresponding frequency Fs, is correlated with frequency Fi of a corresponding one of the local sensor identification frequencies Fi. There is, therefore, a one to one correspondence between the count in counter 59 and the local sensors 2-1 through 2-N of FIG. 1. In a preferred embodiment described, the number N is 18 and the maximum count attained by counter 59 is 19.

In FIG. 4, the gate 61 is a conventional decoder which receives the 4, 8, 16, 32 and 64 outputs of the counter 59. Decoder 61 receives inverted signals for the count lines 16 and 32 and hence decodes binary 10011, a count of 19.

The output from gate 61 connects to the clock input of a conventional D-type flip-flop 42. The D input of flip-flop 42 connects to Vcc and hence receives a logical 1. The Q and Q* outputs of flip-flop 42 connect to the C inputs of gates 51 and 52, respectively. The outputs of flip-flop 42, therefore, control whether the Fo or Ft frequency is selected. Flip-flop 42 is reset when a 1 occurs on its R input.

Flip-flop 41 is a conventional JK-type flip-flop. Flip-flop 41 is clocked by the 2 output of counter 59. The K input of flip-flop 41 is connected to Vcc and hence receives a logical 1. The J input of flip-flop 41 is connected from the 4 output of counter 59. Flip-flop 41 is reset when a logical 1 appears on its R input from OR gate 46. The Q output of flip-flop 41 connects to AND gate 44 and the Q* output connects to OR gate 45. Flip-flop 41 operates to toggle for each count of counter 59 during the time when the local sensors 2 of FIG. 1 are being tested to determined if they are operating properly. Whenever a proper local sensor signal is detected during a test, a signal appears on line 95 which together with the Q output of flip-flop 41 satisfies the AND gate 44. When gate 44 is satisfied its output goes from a 0 to a 1. That 1 is connected through the OR gate 43 and through the OR gate 45. The output from gate 45 therefore has a 0 to 1 transition at the time when AND gate 44 is satisfied. The 0 to 1 transition is input to clock the single shot 67 which produces a 1 output for a $10^{-4}$ second time-out period. During that time-out period, the flip-flop 41, through the OR gate 46, is reset. While the output from gate 45 is 1, and before flip-flop 41 is reset, the 1 is propogated through OR gate 47 to the C input of gate 58. Gate 58 is thereby enabled momentarily to step the counter 59 to select a new frequency on line 89. When the 2 output of counter 59 is stepped, the 2 output clocks flip-flop 41 to again cause a 1 on its Q output. Flip-flop 41, in this manner, is stopped at each significant count of counter 59 that is, on each of the 19 counts which affect the high order bits 4, 8, 16, 32 and 64. If after each new count an appropriate signal is detected on line 95, the signal is passed through gate 44 allowing gate 58 to be opened and allowing counter 59 to be stepped to the next count.

After counter 59 has counted to a count of 19, gate 61 is satisfied and provides a 0 to 1 clocking transition which is supplied to clock flip-flop 42. When clocked flip-flop 42 provides a 1 on its Q output which is conducted through OR gate 47 to the C input of gate 58. Therefore, when flip-flop 42 is clocked by gate 61, gate 58 remains open allowing counter 59 to be stepped continually. Flip-flop 42 is only reset by a 1 on its R input when a 1 appears on the master reset line (from the Q* output of flip-flop 48). When test frequencies are being generated, the Q output of flip-flop 42 is 0 so that gate 51 is held closed. Similarly, at that time, the Q* output of flip-flop 42 is a 1 so that gate 52 is continuously held open. Upon the clocking of flip-flop 42 by the output from gate 61, the Q output of flip-flop 42 goes to 1 and the Q* output goes to 0 reversing the states of gates 51 and 52. Gate 51 then becomes operative to pass the Fo frequency.

Counter 62 and counter 63 each count the pulses output from gate 58 and together contain the same number which is present in the binary counter 59. The counters 62 and 63 include decoder outputs which are connected to the conventional 7 segments displays 64 and 65, respectively. The displays 64 and 65 display, in decimal form, the number which is contained in the counter 59. During the test sequence, the displays 64 and 65 display a number which corresponds to the number of the particular one of the sensors 2 of FIG. 1 which is being tested.

The on/off state of the central control of FIG. 4 is controlled by the on/off control 50. Control 50 is typically a momentary contact switch which, when activated, provides a pulse to a conventional one-shot circuit 49. Upon receiving a pulse, one-shot 49 provides an output for a duration of $10^{-4}$ seconds. Each output from one shot 49 operates to clock the conventional D-type flip-flop 48. The Q* output of flip-flop 48 is connected to its D input. Each clock pulse input to flip-flop 48 operates to toggle flip-flop 48 so that its Q and Q* outputs alternately change states for each clock input. The Q* output of flip-flop 48 is the master reset line. The Q* output connects to the counter stages 62 and 63, the counter 59, the phase locked loop 87 (as an inhibit), the flip-flop 42, a flip-flop 69, a flip-flop 74, 15 second single shot 75, and a set/reset latch 103. The Q output of flip-flop 48 connects as an enable input to the counters 62 and 63, an AND gate 76, and through a resistor 82 to flip-flop 107.

The Q output of flip-flop 42 connects as an enable input to a NAND gate 71. When flip-flop 42 has been clocked by gate 61, gate 71 becomes enabled by a 1. When thus enabled, gate 71 is responsive to a logic level 1 on the line 95. If a 1 appears on line 95, indicating that a local sensor 2 of FIG. 1 has had its sensor conductor 3 disturbed (e.g. by an intruder), then gate 71 becomes satisfied. When satisfied gate 71 provides a 1 to 0 transition which triggers the conventional 30 second timer 70. Timer 70 provides a 1 output for 30 seconds which enables AND gate 72 for that 30 second period.

AND gate 72 is satisfied to pass a signal any time during the 30 second period when the timer 70 is timing out provided that a 1 is output from the AND gate 73 and a 1 is also output from the inverter 96.

The AND gate 73 is connected to receive inputs from the conventional flip-flop 74 and the OR gate 97. The OR gate 97 collects the output from the interior sensor 7. Gate 97 may also receive inputs from additional interior sensors such as sensor 7' (shown dotted). The interior sensor 7 is the device previously described in connection with FIGS. 1 and 2. In the event that two or more sensors are required to create a field which covers the entire volume of the enclosure 4 in FIG. 2, additional sensors, such as sensor 7' in FIG. 4, produce an output which is also connected to the OR gate 97. If either sensor 7 or 7' provide a 1 output, then gate 97 provides a 1 output.

Another type of sensor, such as sensor 7″ may be connected as an input to the AND gate 73. If so connected, then gate 73 is only satisfied with a 1 from either sensor 7 or sensor 7′, a 1 from sensor 7″, and a 1 from flip-flop 74. Of course, any other logical combination of sensor signals may be employed also.

In a preferred embodiment, it will be assumed that only the interior sensor 7 and the flip-flop 74 provide an input to AND gate 73 so that gate 73 becomes a 2-input gate.

Flip-flop 74 is clocked to produce a 0 on its Q* output by an input from the control switch 83. Flip-flop 74 is reset by a 1 on its R input to provide a 1 on its Q* output. The R input of flip-flop 74 is connected to the Q* output of the on/off flip-flop 48. Control switch 83 and flip-flop 74 function to act as an "AT HOME" switch to disable gate 73 and therefore to disable gate 72.

The inverter 96 inverts the output from the conventional 60 second timer 68. Timer 68 functions, through inverter 96, to provide a 60 second inhibit to the gate 72. Timer 68 is energized with a 1 to 0 transition on its T input. A 1 to 0 transition occurs by actuation of a conventional switch 98. Switch 98 is employed, for example, to obtain a 60 second delay when a person is intending to leave the enclosure 4 of FIG. 2. The 60 second timer 68 is reset by a 1 on the R input as derived from the Q output of flip-flop 42.

Providing that the 60 second timer 68 has not been triggered, the output from inverter 96 is a 1. The 1 from inverter 96, coincident with a 1 from the AND gate 73 and a 1 from the 30 second timer 70 satisfy the AND gate 72. When gate 72 becomes satisfied, a 0 to 1 transition is input to trigger the 15 second timer 75.

A 0 to 1 transition output from gate 72 triggers the 15 second single shot 75. The Q* output from single shot 75, when triggered, immediately switches to 0 and hence disables the AND gate 76 for 15 seconds. The output from gate 72 is also connected to the S input of set/reset latch 103. A 1 from gate 72 sets latch 103 to provide a 1 on its Q output. That 1 enables AND gate 76. After the 15 second time out of one-shot 75, its Q* output is switched to 1 and enables gate 76. If flip-flop 48 remains with a 1 on its Q output, gate 76 is satisfied to produce a 1 on its output. That one provides an alarm signal output from NOR gate 77. Anytime during the 15 second time out of one-shot 75, the output which would otherwise occur from gate 76 can be prevented by closure of switch 50. Additional alarm signals (e.g. fire, panic, tamper switches) can be generated on line 99 from any external alarm source (not shown) having an input over line 101.

In FIG. 4, switch 84 is provided which triggers a conventional one-shot 66. When triggered by switch 84, one-shot 66 provides a 1 output which is connected through OR gate 43, OR gate 45, and OR gate 47 to enable the gate 58 to step counter 59 to the next step. Switch 84, is a manual override switch which enables the control of FIG. 4 to be stepped to the next sensor test when the current sensor under test does not provide back an appropriate signal on line 95.

In FIG. 4, a test light 90 is connected through an inverter to the output of the OR gate 47. Light 90 therefore indicates when illuminated a NOT SECURE condition.

Light 91 is connected to the Q output of the flip-flop 42 and functions when illuminated to indicate a SECURE condition.

A buzzer 92 is connected on the output from the 30 second timer 70. When the buzzer 92 is energized, it indicates that one of the local sensors 2 has sensed an intrusion. The buzzer 92 is distinguished from the output from AND gate 76, as it appears on line 99, in that only a local sensor is required to energize buzzer 92. In order for the AND gate 76 to be energized, however, both a local sensor output as indicated from timer 70 and an interior sensor 7 must both be present within the timer interval, 30 seconds, provided by the timer 70. This predetermined time relationship between the interior sensor intrusion detection and the local sensor intrusion detection aides in the rejection of false alarm conditions. For example, disturbance of a local sensor does not cause the final alarm signal (only a warning signal through buzzer 92) unless followed within thirty seconds by an interior sensor signal. Hence, false alarms of only the local sensors are rejected by the system. Although a small mathematical probability exists that both a local sensor and an interior sensor will false alarm within the time interval, this probability is very low. The probability of false alarms in the present invention is even lower than the combined probability of two redundant sensors of the same type having concurrent false alarms. The present invention has a lower probability since diverse types of sensors are employed where each has different false alarm characteristics. Of course, the time relationship between sensor signals may be selected at many different values by selecting different time-outs for timer 70.

In FIG. 4, the output from the NAND gate 71 is connected as an input to the AND gate 104. When gate 71 is not satisfied, it produces a 1 output which enables the AND gate 104. When enabled, gate 104 functions to pass the clock pulses from the analog gate 58 to the counters 62 and 63. Whenever a signal appears on line 95 during a non-test operation, the output from gate 71 goes from 1 to 0 indicating a disturbance of a local sensor. The 0 output from gate 71 inhibits clock pulses from passing through the gate 104 and hence stops the counters 62 and 63. The counters 62 and 63 are stopped at a count which corresponds to that one of the local sensors 2 of FIG. 1 which has caused the signal to occur on line 95. The displays 64 and 65 therefore display the number of the sensor which is detecting an intrusion.

In FIG. 4, flip-flop 69 is a conventional D-type flip-flop which is reset by a 1 on its R input when a 1 appears on the Q* of the flip-flop 48. The Q output from flip-flop 69 drives a lamp 93. When lit, lamp 93 gives a READY indication. When flip-flop 48 is off, a 1 on its Q* output holds flip-flop 69 reset so that flip-flop 69 has a 0 on its Q output. When control 50 causes flip-flop 48 to be switched to the ON state with a 0 on its Q* output, the reset signal from flip-flop 69 is removed.

Flip-flop 107 is also a conventional D-type flip-flop which is reset on its R input from the Q* output of flip-flop 48. Flip-flop 107 receives its D-input from the Q output of flip-flop 42. Flip-flop 107 can only be clocked to a 0 on its Q* output, therefore, after the test period is over when flip-flop 42 is clocked to have a 1 on its Q output.

Thereafter, when switch 98 is closed and reopened, flip-flop 107 is clocked causing its Q* to go from 1 to 0. That 1 to 0 fires timer 68 and inverter 96 goes from 1 to 0. That 1 to 0 transition from inverter 96 does not clock flop-flop 69. After the 60 second time-out of timer 68, a 1 to 0 transition is inverted in inverter 96 to a 0 to 1 transition. That 0 to 1 transition clocks flip-flop 69 setting its Q output to a 1 thus illuminating the lamp 93. Lamp 93 therefore indicates when the 60 second timer 68 has timed out and thereby has made the system operational.

In FIG. 3, impedance transfer circuit 24 may include a conventional temperature compensating circuit 105. Circuit 105 for example includes a temperature-sensitive transistor (not shown) having its emitter-collector connected between the emitters of transistors 40 and 41 and the resistor connected to ground. In such a case, the transistor (not shown) has its base connected to an appropriate bias level between Vcc and ground.

CHART I

| Local Sensor | Fi | Fo-Fi | Ft-Fi | Fso | Fst | Fso-(Fo-Fi) | Fst-(Ft-Fi) |
|---|---|---|---|---|---|---|---|
| 2-1 | 25.00 | 450.00 | 453.71 | 475.00 | 478.71 | 25.000 | 25.000 |
| 2-2 | 25.93 | 449.07 | 452.78 | 474.072 | 477.775 | 25.002 | 24.995 |
| 2-3 | 26.86 | 448.14 | 451.85 | 473.144 | 476.840 | 25.004 | 24.990 |
| 2-4 | 27.79 | 447.21 | 450.92 | 472.216 | 475.905 | 25.006 | 24.985 |
| 2-5 | 28.72 | 446.28 | 449.99 | 471.288 | 474.970 | 25.008 | 24.980 |
| 2-6 | 29.65 | 445.35 | 449.06 | 470.360 | 474.035 | 25.010 | 24.975 |
| 2-7 | 30.58 | 444.42 | 448.13 | 469.432 | 473.100 | 25.012 | 24.970 |
| 2-8 | 31.51 | 443.49 | 447.20 | 468.504 | 472.165 | 25.014 | 24.965 |
| 2-9 | 32.44 | 442.56 | 446.27 | 467.576 | 471.230 | 25.016 | 24.960 |
| 2-10 | 33.37 | 441.63 | 445.34 | 466.648 | 470.295 | 25.018 | 24.955 |
| 2-11 | 34.30 | 440.70 | 444.41 | 465.720 | 469.360 | 25.020 | 24.950 |
| 2-12 | 35.23 | 439.77 | 443.48 | 464.792 | 468.425 | 25.022 | 24.945 |
| 2-13 | 36.16 | 438.84 | 442.55 | 463.864 | 467.490 | 25.024 | 24.940 |
| 2-14 | 37.09 | 437.91 | 441.62 | 462.936 | 466.555 | 25.026 | 24.935 |
| 2-15 | 38.02 | 436.98 | 440.69 | 462.008 | 465.620 | 25.028 | 24.930 |
| 2-16 | 38.95 | 436.05 | 439.76 | 461.080 | 464.685 | 25.030 | 24.925 |
| 2-17 | 39.88 | 435.12 | 438.83 | 460.152 | 463.750 | 25.032 | 24.920 |
| 2-18 | 40.81 | 434.19 | 437.90 | 459.224 | 462.815 | 25.034 | 24.915 |

SUMMARY OF OPERATION

The operation of the intrusion and detection alarm system of FIG. 1 commences by making the system ready. Referring to FIG. 4, the system is initially off so that the Q* output of flip-flop 48 is a 1. If the system of FIG. 4 is on, then the control switch 50 can be actuated to turn the system off. With a 1 on the Q* output of flip-flop 48, the various counters and other circuits are reset as previously described. Also a 0 appears on the Q output of flip-flop 48 so as to disable counters 62 and 63 and the AND gate 76.

In order to ready the system, the control 50 is actuated to fire single shot 49 which in turn clocks flip-flop 48 to produce a 0 on its Q* output and a 1 on its Q output. With the on/off flip-flop 48 thus switched, the system is ready for operation. Flip-flop 42 is reset and therefore gate 52 and gate 58 are operative to conduct while gate 51 is not. The test sequence therefore is initiated and clocking pulses pass from counter 54, through the gate 58, to the counter 59.

Figure 5:
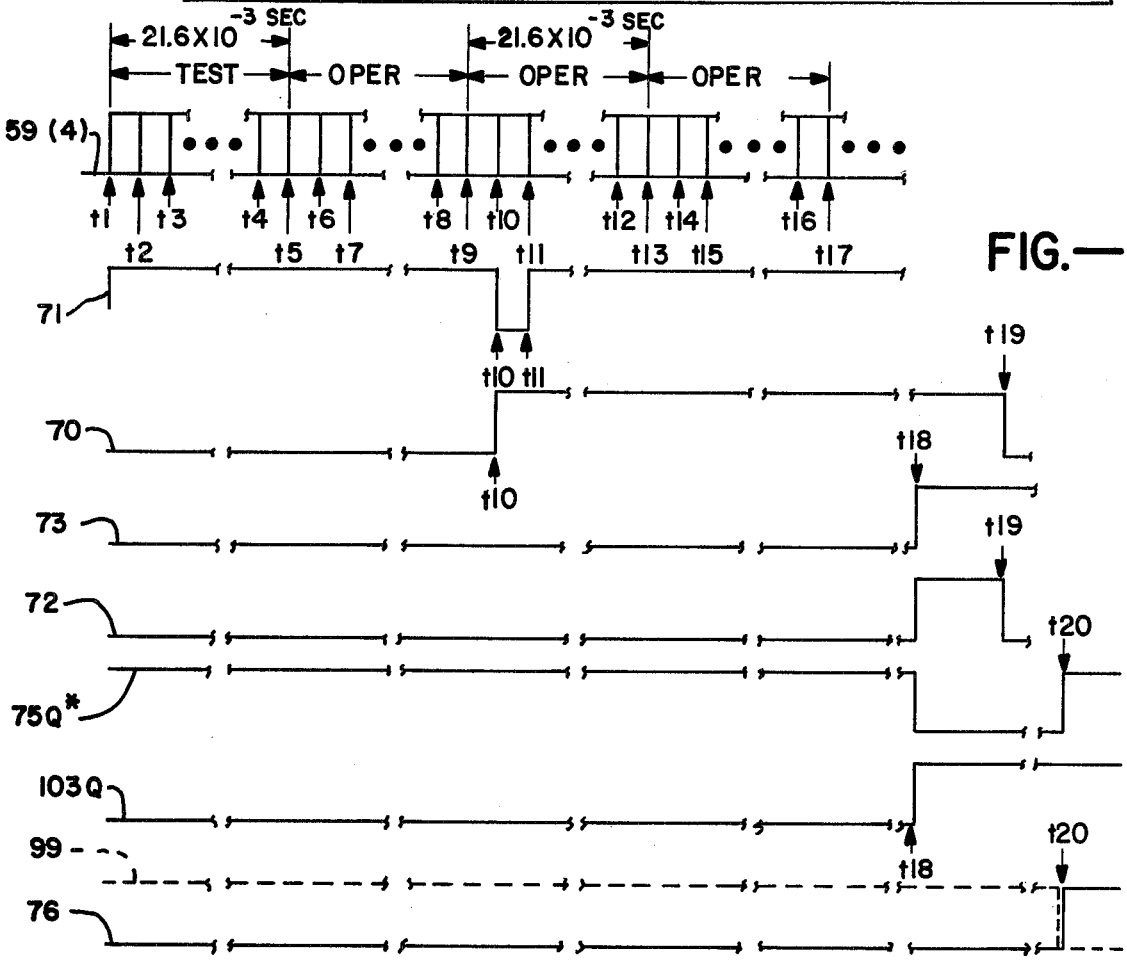
FIG. 5 depicts waveforms representative of the operation of the FIG. 1 apparatus.

As previously described, counter 59 is stepped through 19 different counts. Referring to FIG. 5, the counts in the counter 59 are represented by the waveform 59(4). The first test count of one, corresponding to a first local sensor (e.g. sensor 2-1 in FIG. 1), is latched in the counter 59 at time t1. With the first number in counter 59, the synthesizer 60 receives that number and generates the Est signal (478.71 KHz) on line 89. At the same time, the gate 52 is conducting to produce through capacitor 85 the test frequency Ft (478.71 KHz) on the power line 12-1.

Referring to FIG. 3, the local sensor 2-1 receives the Ft signal on power line 12-1 and conducts that signal into loop 22. A filter (not shown) can be provided between capacitor 16 and loop 22. Such a filter would insure that output signals through capacitor 17 did not disturb the operation of loop 22. In the embodiment described the filter would have a center frequency of approximately 475 KHz. Loop 22 locks on the Ft frequency and provides that frequency as an output on line 35. At the same time the output on line 27 from loop 22 is properly filtered and sensed to enable the identity frequency oscillator 32. For local 2-1, the oscillator 32 provides an output frequency, Fi, (25 KHz) which is mixed with Ft in mixer 20 and filtered in low-pass filter 19 to produce the signal Ft-Fi on line 40. The signal on line 40 is propagated through enabled gate 18 and capacitor 17 to the power line 12-1.

In FIG. 4, the signal Ft-Fi appears on the power line 12-1 and is input through the capacitor 86 to the low-pass filter 81, the amplifier 80 to the mixer 79. In mixer 79, the Ft-Fi signal is mixed with the Fst signal 478.71 KHz to form the sum and difference signals which are limited and demodulated in circuit 78. Mixer 79 includes a band-pass filter for selecting the filtered signal, Fst-(Ft-Fi) which is 25 KHz for sensor 2-1. The filter within mixer 79 has a center frequency of approximately 25 KHz and must pass signals between 25.034 to 24.915 KHz. Also, the band pass filter must exclude signals which are approximately ±0.92 KHz or more away from the center frequency. If the local sensor 2-1 in FIG. 3 has properly supplied the signal Ft-Fi, then a 25 KHz signal will be output from mixer and filter 79 as an input to the limiter/demodulator 78. Limiter/-demodulator 78 in response to a 25 KHz signal produces a logical 1 on the line 95 which satisfies enabled AND gate 44. An output from gate 44 signifies that the local sensor 2-1 has properly responded to the test signal.

After gate 44 has been satisfied to signify that a proper test sequence has occurred for sensor 2-1, its output causes the counter 59 to be incremented to the next step as previously described. Alternatively, if the local sensor 2-1 does not properly respond, the manual override button 84 can be depressed to cause the test sequence to increment to the next count in counter 59.

The procedure as previously described in connection with the local sensor 2-1 is repeated for local sensor 2-2 when counter 59 is clocked to the next count. Referring to FIG. 5, the second count of the test sequence is clocked into counter 59 at time t2. The procedure previously described in connection with local sensor 2-1 is now again repeated for local sensor 2-2. The appropriate signal frequencies for the various signals associated with the local sensors 2-1 through 2-18 are shown in the above CHART I.

In a similar manner, the counts for each of the N local sensors of FIG. 1 are stored in the counter 59. In the particular example described, the value of N is 18. Referring to FIGS. 5, the local sensor 2-3 has its corresponding count clock into counter 59 at t3 and so on until the 18th count is clocked into counter 59 on the count immediately preceding *t*4.

After the 18th sensor has been tested, a 19th count is clocked into counter 59 at t4.

The 19th count is immediately decoded by the decoder 61 in FIG. 4. Decoder 61 resets through OR gate 106 the counter 59 and the counters 62 and 63 as well as clocking flip-flop 42.

With the counters reset and flip-flop 42 clocked, gate 58 is enabled in the conducting state to continuously step the counters 59, 62 and 63. The next count associated with the sensor 2-1 is clocked into counter 59 at t5 to commence the operation phase of the system.

At t5 time, gate 51 is enabled to apply the Fo signal to the power line 12-1 for transmission to the local sensor of FIG. 3.

In FIG. 3, the Fo frequency is sensed by the loop 22 and causes loop 22 to lock on the Fo frequency. Loop 22 provides the Fo frequency on line 35 to mixer 20. Unless the sensor conductor 3 is disturbed to indicate an intrusion, the oscillator 32 does not provide an Fi output signal and hence the signal output from gate 18 is Fo.

Referring to FIG. 4, the Fo output signal from the local sensor means that the line 95 from the demodulator 78 remains at t5 time a logical 0 and the output from gate 71 remains a logical 1. As shown in FIG. 5 at t5 time, the outputs from the elements 70, 73, 72, 103Q and 76 of FIG. 4 all remain 0's while the output 71, 75Q* and 99 remain 1's.

At time t6, the second number corresponding to local sensor 2-2 is clocked into counter 59. Again, in the particular example described, no signal appears on the line 95 for sensor 2-2 or any of the remainder of the sensors. After all 18 sensors have been interrogated, the 19th count is clocked into counter 59 at time t8. At t8, the 19th count is decoded by decoder 61 and counters 59, 62 and 63 are reset through OR gate 106.

Again referring to FIG. 5, the operation sequence is again repeated with the first count clocked into counter 59 at time t9. Again the corresponding local sensor 2-1, does not provide a signal indicating that its sensor conductor has not been disturbed. Accordingly at t9 time line 95 in FIG. 4 remains a 0 and the output from gate 71 remains a 1.

At time t10, the count corresponding to the local sensor 2-2 is clocked into counter 59. At this time, in the particular example described, a disturbance has been caused to the sensor conductor 3-2 of the local sensor 2-2. The disturbance is recognized in the following manner.

In FIG. 4, gate 51 passes the Fo frequency to the line 12-1. The local sensor 2-2, see FIG. 3, receives the Fo frequency on line 12-1 where it is passed to the phase locked loop 22. Because the sensor conductor 3-2 is disturbed, the output from loop 22 on line 27 is changed thereby enabling, after proper filtering and detection, the oscillator 32. Oscillator 32 for the local sensor 2-2 produces the Fi signal at a frequency of 25.93 KHz (see CHART I). That Fi frequency is mixed and filtered to provide the signal Fo-Fi which is returned over the power line 12-1 to the central control of FIG. 4.

In FIG. 4, the filter 81, amplifier 80, mixer/filter 79 and limiter/demodulator 78 function to detect the intrusion signal and produce a logical 1 on line 95. The 1 on line 95 causes gate 71 to have its output go from 1 to 0 as indicated at t10 in FIG. 5. The negative-going transition at t10 clocks the 30 second timer 70 causing its output to go from 0 to 1 at t10. The output of timer 70 remains high for a duration of 30 seconds, that is, until t19.

The counter 59 continues to operate after t10 in the same manner that it did before. When counter 59 again gets to the count corresponding to the local sensor 2-2, that is, at time t14, no output from gate 71 is indicated in FIG. 5. Typically an output would occur at this time and for a plurality of additional operation cycles. For each cycle that an output does occur, the timer 70 is retriggered thereby extending the time out period for a new 30 second duration which would be after t19. For convenience of explanation, however, only one such detection is shown in FIG. 5, and that is between t10 and t11.

At t18, an output from interior sensor 7 is indicated by a logical 1 output from AND gate 73 as shown in FIG. 5. The interior sensor 7 typically will produce an output sometime after the local sensor has been disturbed. The time interval between the local sensor disturbance t10 and the interior sensor disturbance at t18 is variable and somewhat random. The interval depends upon the characteristics of the overlapping fields of the local sensor and the interior sensor and upon the path and speed of the intruder. A necessary requirement for operation of the FIG. 4 embodiment is that the interior sensor be disturbed within 30 seconds after the local sensor disturbance has been detected. Referring to FIG. 5, the interior sensing of disturbance (shown at t18) must occur sometime between t10 and t19.

When the gate 73 provides an output at t18, gate 72 becomes satisfied at t18 and has a 0 to 0 transition. That 0 to 1 transition functions to clock the timer 75 so that its Q* output goes from 1 to 0. Also at t18 the latch 103 is set with a 1 on its Q output. With 103Q set to a 1, gate 76 is satisfied at t20 after the 15 second time-out of timer 75. If at any time between t18 and t20, that is during the time-out period of gate 75, the on/off switch 50 is actuated, then gate 76 is prevented from going from 0 to 1 and hence the alarm is inhibited. In the example of FIG. 5 however, control 50 is not actuated so that the alarm signal appears from gate 77 as a 1 to 0 transition at t20.

FURTHER AND OTHER EMBODIMENTS

While the system of FIG. 1 has been described in terms of preferred embodiments, many variations will be apparent to those skilled in the art.

The number of local sensors and interior sensors which are employed in connection with any enclosure are of course variable. Also, the specific frequencies and timing values discussed in connection with FIGS. 3 and 4 can be selected at many different values. The particular values selected are only by way of example.

Referring to the local sensor of FIG. 3, an alternative for identity frequency oscillator 32 may be utilized. Such an alternative preferred embodiment utilizes a direct count-down of the Fo/Ft signal from the phase locked loop 22. In one particular example, an AND gate (not shown) is connected to receive the Fo or Ft signal. That AND gate is connected to receive an enabling-/disabling input from line 30. An output from that AND gate is connected to a first counter (not shown) which is, for example, a 4-bit binary counter. The 4-bit counter is operative, therefore, to count in response to either the Fo or the Ft signal whenever the signal on line 30 is a 1. The output from the 4-bit binary counter is input to a second counter (not shown) which is designated as a divide-by-M counter. The value of M is different for each one of the local oscillators. The value of M therefore allows a different identity frequency to be specified for each local oscillator. The output from the divide-by-M counter is input to a mixer (not shown) along with the output from the 4-bit counter to form the sum and difference signals. Thereafter, the output from the mixer is connected to a high-pass filter (not shown) to select the sum output from the mixer. The output from the high-pass filter is the Fi frequency which is input to the mixer 20 of FIG. 3. When the alternate embodiment described is employed, the oscillator 32 and inverter 33 of FIG. 3 are, of course, removed from the FIG. 3 circuit.

The present invention has been described as having two or more sensors which rely on different types of detection operation. For the purposes of the specification and claims, "different type of detection operation" is intended to mean detection operations which rely upon different phenomena. For example, one sensor relies upon disturbing a capacitive field. Another type of sensor relies upon radar detection. Other types of phenomena are interrupting a light beam or disturbing an ultrasonic wave.

While the present invention has been described in connection with a frequency sensitive system having local sensors which signal at different frequencies, the sensor output signal can be of other types. For example, amplitude modulated signals at identifying modulation frequencies and time division multiplex signals can be employed.

While two different types of identity frequency generators have been described, other types can be employed. For example, gate controlled cyrstal oscillators and other types of frequency generators also may be employed for use in the local sensors.

While a phase locked loop frequency synthesizer has been described, other types of frequency generators may be employed in the central control. For example, separate oscillators, one for each descrete frequency required, can be employed. A voltage controlled oscillator or any other well known means for generating selectable frequencies can be employed.

While the present invention has been described in one preferred embodiment with one predetermined time relationship between local sensors and one or more interior sensors, other time relationships are possible. For example, local counters may be added for each local sensor (preferrably in the central control) to count the presence of a local sensor output signal for a plurality of operating cycles (e.g. five). An alarm signal is then generated only if the interior sensor detection signal occurs within a predetermined time period (e.g. 30 seconds) after five consecutive intrusion-caused output signals from the same local sensor have occurred. The time relationship between interior and local detection signals may have many similar variations like the ones described. This time relationship is particularly important in reducing the probability of a false alarm by the overall intrusion system.

What is claimed is:

1. An intrusion detection apparatus for detecting intrusions into an enclosure comprising:

first sensor means for detecting intrusions within a first portion of said enclosure and responsively providing a first sensor output signal, second sensor means, having a different type of detection operaton than said first sensor means, for detecting intrusions within a second portion of said enclosure and responsively providing a second sensor output signal, where said second portion is in close proximity to said first portion, control means for detecting said first and second sensor output signals, said control means including means for sensing when said first and second sensor output signals occur within a predetermined time relationship, and said control means including means for generating an alarm signal when said first and second sensor output signals occur within said predetermined time relationship.

2. An instrusion detection apparatus for detecting instrusions into an enclosure comprising:

generation means for generating a control signal at a control frequency, first sensor means for detecting instrusions within a first portion of said enclosure and responsively providing a first sensor output signal, said first sensor means including a sensor conductor for changing reactance in response to the presence of a body within said first portion, including a phase locked loop connected to receive the control signal and connected to said sensor conductor, operative to lock on said control frequency and detect changes in reactance of said sensor conductor to provide a loop output signal having an amplitude responsive to said control frequency and said changes in reactance, and includes sensor generator means for generating said first sensor output signal in response to said loop signal, second sensor means, having a different type of detection operation than said first sensor means, for detecting intrusions within a second portion of said enclosure and responsively providing a second sensor output signal where said second portion is in close proximity to said first portion, control means for detecting said first and second sensor output signals, said control means including means for sensing when said first and second sensor output signals occur within a predetermined time relationship, and said control means including means for generating an alarm signal when sad first and second sensor output signals occur within said predetermined time relationship.

3. The apparatus of claim 2 wherein said sensor conductor is a wire exhibiting changes in capacitance in response to a body passing in proximity to said wire.

4. The apparatus of claim 1 wherein said second sensor means includes field generation means for providing a field within said second portion where said second portion includes substantially the entire volume of said enclosure and whereby said second sensor means provides a second sensor output signal in response to movement of a body within said second portion.

5. The apparatus of claim 4 wherein said field generation means includes means for generating an omni-directional field within said second portion.

6. The apparatus of claim 5 wherein said field generation means includes a radar system and said omni-directional field is a radar field.

7. The apparatus of claim 5 wherein said field generation means includes an ultrasonic system and said omnidirectional field is an acoustical field.

8. The apparatus of claim 2 wherein said first sensor means includes, means for sensing said loop output signal to provide a sensed output signal, means for generating an identity frequency signal in response to said sensed output signal, mixer means for mixing the identity frequency signal with the loop frequency signal to form up and difference signals, filter means for selecting a sensor signal from said sum and difference signals to provide the first sensor output signal.

9. The apparatus of claim 2 wherein said generation means includes means for generating said control signal with said control frequency at a test frequency or at an operating frequency and wherein said phase locked loop provides said loop output signal in response to said test frequency or in response to said operating frequency in combination with a change in capacitance of said sensor conductor.

10. The apparatus of claim 1 wherein said control means includes timer means for establishing a time period in response to detection of said first sensor output signal and includes means for providing an alarm signal in response to detection of said second sensor output signal only during the presence of said time period.

11. The apparatus of claim 1 wherein said first and second portions of said enclosure overlap at least in part.

12. The apparatus of claim 11 wherein said first and second portions do not overlap.

13. The apparatus of claim 1 wherein said first sensor means includes means for generating a first field encompassing said first portion and wherein said second sensor means includes means for generating a second field encompassing said second portion where said second portion overlaps said first portion at least in part.

14. An intrusion detection apparatus for detecting intrusions into an enclosure comprising:

a plurality of first sensor means each for respectively detecting intrusions within a plurality of different first portions of said enclosure and responsively providing a plurality of first sensor output signals, second sensor means, having a different type of detection operation than said first sensor means, for detecting intrusions within a second portion of said enclosure and responsively providing a second sensor output signal, where said second portion is in close proximity to said first portion, common transmission means coupled to said first sensor means for conducting said first sensor output signals, control means coupled to said transmission means for detecting said first and second sensor output signals, said control means including means for generating an alarm signal only when at least one of said first sensor output signals and said second sensor output signal have a predetermined time relationship.

15. The apparatus of claim 14 wherein each of said first sensor means includes, a sensor conductor exhibiting changes in capacitance in response to the presence of a body within said first portion, a phase locked loop connected to receive said sensor conductor, operative to lock on a loop frequency and to provide a loop frequency signal, said phase locked loop providing a loop output signal in response to a change in capacitance of said sensor conductor, means for sensing said loop output signal to provide a sensed output signal, means for generating an identity frequency signal in response to said sensed output signal, each of said first sensors having an identity frequency signal of a different frequency, mixer means for mixing the identify frequency signal with the loop frequency signal to form sum and different signals, filter means for selecting a sensor signal from said sum and difference signals to provide a first sensor output signal, each of said first sensors having an output signal of a different frequency.

16. The apparatus of claim 14 wherein said control means includes detection means for sequentially stepping to detect each of said first sensor output signals.

17. The apparatus of claim 16 wherein said detection means includes, a counter for sequentially storing counts corresponding to each of said first sensor means, a frequency synthesizer responsive to the count in said counter for generating synthesizer signals for detecting the first sensor output signals, a synthesizer signal of different frequency for each of said first sensor means, mixer means for forming sum and difference signals from each sensor output signal and a corresponding synthesizer signal, when said sensor output signal is provided, filter means for selecting a detection signal from said sum and difference signals.

18. The apparatus of claim 17 including display means for sequentially displaying counts in said counter corresponding to said first sensor means.

19. The apparatus of claim 18 including means for stopping said display means at a count corresponding to one of said first sensor means providing a first sensor output signal.

20. In an intrusion alarm system, first means for generating a plurality of first intrusion detection signals, second means for generating one or more second intrusion detection signals, common transmission means coupled to said first means for conducting said first intrusion detection signals, control means coupled to said transmission means for detecting said first and second intrusion detection signals, said control means including means for sensing when said first and second intrusion detection signals occur within a predetermined time relationship, and said control means including means for generating an alarm signal only when said first and second intrusion detection signals occur within the predetermined time relationship.

21. The apparatus of claim 15 where said control means includes means for generating said control frequency at a test frequency or at an operating frequency for transmission to said first sensor means over said common transmission means and wherein said phase locked loop for each of said first sensor means provides said loop output signal in response to said test frequency or in response to said operating frequency in combination with a change in capacitance of said sensor conductor.

22. An intrusion detection apparatus for detecting intrusions into an enclosure comprising:

generation means for generating a control signal at a test frequency or at an operating frequency, a plurality of first sensor means each for establishing a field for detecting intrusions within a plurality of portions of said enclosure, respectively, each of said first sensor means connected to said generation means for receiving said control signal and including means for providing an identifying first sensor output signal responsive to changes in said control signal and responsive to changes in the respective field, control means including means sensing the presence of said first sensor output signals for sensing an intrusion or a test condition including means for selectively controlling said generation means to switch from said operating frequency to said test frequency whereby each of said first sensor means is caused to produce the respective first sensor output signal to test each of said sensor means.

23. The apparatus of claim 22 including second sensor means having a different type of detection operation than said first sensor means for detecting intrusions into said enclosure and responsively providing a second sensor output signal and wherein said control means includes timing means for detecting at least one of said first sensor output signals and for detecting said second sensor output signal and includes alarm means for generating an alarm signal when said first and second sensor output signals occur within a predeterminted time relationship.

24. An intrusion detection apparatus for detecting intrusions into an enclosure comprising:

generation means for generating a control signal at a test frequency or at an operating frequency, a plurality of first sensor means each having a sensor conductor for establishing a field for detecting intrusions within a plurality of first portions of said enclosure, respectively, each of said first sensor means including phase locked loop means connected to said generation means for receiving said control signal and connected to said sensor conductor for providing an identifying first sensor output signal responsive to changes in said control signal and responsive to changes in the respective field, second sensor means having a different type of detection operation than said first sensor means for detecting intrusions into a second portion of said enclosure and responsively-providing a second sensor output signal, said second sensor means including field generation means for providing a field covering a predetermined volume of said enclosure, common transmission means for conducting said first sensor output signals and said control signal, control means coupled to said transmission means including means for sensing the presence of said first sensor output signals and thereby for sensing an intrusion or a test condition; including means for selectively controlling said generation means to switch from said operating frequency to said test frequency whereby each of said first sensor means is caused to produce a respective first sensor output signal and thereby to test each of said first sensor means; including means for detecting at least one of said first sensor output signals and for detecting within a predetermined time relationship said second sensor output signal, and including alarm means for generating an alarm signal when said first and second sensor output signals occur within a predetermined time relationship.

25. The apparatus of claim 1 wherein said first sensor means includes, a sensor conductor exhibiting changes in capacitance in response to the presence of a body within said first portion, a phase locked loop connected to receive said sensor conductor, operative to lock on a loop frequency and to provide a loop frequency signal, said phase locked loop providing a loop output signal in response to a change in capacitance of said sensor conductor, means for sensing said loop output signal to provide a sensed output signal, means for generating an identity signal in response to said sensed output signal to provide the first sensor output signal.

26. The apparatus of claim 14 wherein each of said first sensor means includes, a sensor conductor exhibiting changes in capacitance in response to the presence of a body within said first portion, a phase locked loop connected to receive said sensor conductor, operative to lock on a loop frequency and to provide a loop frequency signal, said phase locked loop providing a loop output signal in response to a change in capacitance of said sensor conductor, means for sensing said loop output signal to provide a sensed output signal, means for generating an identity signal in response to said sensed output signal, each of said first sensors having an identity signal exhibiting a different characteristic to provide a different one of the sensor output signals.

27. The apparatus of claim 26 wherein said control means includes detection means for sequentially stepping to detect each of said first sensor output signals.

* * * * *